US006082407A

United States Patent [19]

Paterson et al.

[11] Patent Number: 6,082,407

[45] Date of Patent: Jul. 4, 2000

[54] AUTOMATIC FAUCET ASSEMBLY WITH MATING HOUSING AND HIGH ENDURANCE FINISH

[75] Inventors: Graham H. Paterson, Wilmington; Willard A. Denham, Greenville, both of Del.

[73] Assignee: Speakman Company, Wilmington, Del.

[21] Appl. No.: 09/261,585

[22] Filed: Mar. 3, 1999

[51] Int. Cl.[7] ..... E03C 1/04

[52] U.S. Cl. ..... 137/801; 4/623; 251/129.04

[58] Field of Search ..... 4/623; 137/801; 251/129.04

[56] References Cited

U.S. PATENT DOCUMENTS

| | | |
|---|---|---|
| 3,836,417 | 9/1974 | Yaeger . |
| 3,889,038 | 6/1975 | Wiczer . |
| 4,356,574 | 11/1982 | Johnson . |
| 4,735,357 | 4/1988 | Gregory et al. . |
| 4,762,273 | 8/1988 | Gregory et al. . |
| 4,886,207 | 12/1989 | Lee et al. . |
| 4,896,046 | 1/1990 | Efferding . |
| 4,921,211 | 5/1990 | Novak et al. . |
| 4,955,535 | 9/1990 | Tsutsui et al. . |
| 4,997,618 | 3/1991 | Efferding . |
| 5,025,516 | 6/1991 | Wilson . |
| 5,033,715 | 7/1991 | Chiang et al. . |
| 5,131,428 | 7/1992 | Bory . |
| 5,169,118 | 12/1992 | Whiteside . |
| 5,224,509 | 7/1993 | Tanaka et al. . |
| 5,243,717 | 9/1993 | Yasuo . |
| 5,311,367 | 5/1994 | Ohki et al. . |
| 5,504,950 | 4/1996 | Natalizia et al. . |
| 5,578,675 | 11/1996 | Mormile et al. . |
| 5,586,746 | 12/1996 | Humpert et al. . |
| 5,588,248 | 12/1996 | Cornell et al. ..... 43/43.1 X |
| 5,618,023 | 4/1997 | Eichholz et al. . |
| 5,771,923 | 6/1998 | Paterson et al. ..... 251/129.04 X |
| 5,771,934 | 6/1998 | Warshawsky ..... 137/801 |

*Primary Examiner*—Gerald A. Michalsky
*Attorney, Agent, or Firm*—Connolly Bove Lodge & Hutz LLP

[57] ABSTRACT

An automatic faucet assembly includes a chassis and a cover removably connected to the chassis, wherein both chassis and cover extend above the surface of a deck of a sink basin. The chassis has a mounting section for mounting the chassis to the surface of the deck. A deck plate is mounted between the mounting section and the surface to provide support and stability to the faucet assembly. The faucet assembly further comprises: a fluid conduit extending through the chassis and connecting a fluid discharge port with a fluid supply; an infrared sensor mounted on the chassis for sensing the presence of a user of the faucet assembly; an electrical connector wire extending from the infrared sensor, through an opening in the deck, to a solenoid valve that turns on the fluid supply when infrared sensor senses the presence of the user; and a battery-operated power supply for supplying power to the infrared sensor. The cover connects with the chassis, providing a sealed chamber for the fluid conduit, infrared sensor, electrical connector wire, and power supply. Upon connection of the cover and chassis, a mechanical microswitch is activated by a switch actuator extending from the cover, enabling the power supply to energize the infrared sensor. Cover and deck plate each comprises a zinc die cast layer formed in the shape of the cover and the deck plate, respectively, a metallic polyester layer formed on the zinc die cast layer, and a substantially clear, polymer layer formed on the metallic polyester layer.

15 Claims, 5 Drawing Sheets

AUTOMATIC FAUCET ASSEMBLY WITH MATING HOUSING AND HIGH ENDURANCE FINISH

BACKGROUND OF THE INVENTION

A. Field of the Invention

The present invention relates generally to automatic plumbing fixtures, and, more particularly, to an automatic faucet assembly with mating housing and high endurance finish.

B. Description of the Related Art

Conventional automatic faucets consist of a single or two-piece spout housing that is mounted above a sink basin. Typical two-piece spout housings are shown in U.S. Pat. No. 5,025,516 to Wilson, and U.S. Pat. No. 5,586,746 to Humpert et al. The Wilson faucet comprises a spout body having a cover plate that is removable to provide access to electrical components and a sensor contained in the spout body. A power supply of the Wilson faucet supplies electrical power to the electrical components and the sensor, but is located under the sink basin. The Humpert et al. faucet comprises a core body and an outer sleeve mounting to the core body. The core body includes a removable motion detector and battery for powering the motion detector.

The spout bodies of these conventional automatic faucets, as well as other known plumbing fixtures, typically comprise chrome plating which is visually pleasing to the plumbing fixture user. Unfortunately, chrome plating does not stand up to today's strong chemical cleaners and soaps which eventually corrode the chrome plating, effectively destroying the plumbing fixture.

SUMMARY OF THE INVENTION

An object of the invention is to provide a reliable, easy-to-install and maintain automatic faucet assembly.

Another object of the present invention is to provide an improved plumbing fixture, and, more specifically, an improved automatic faucet assembly.

A final object of the present invention is to provide a corrosion-resistant plumbing fixture, and, more specifically, a corrosion-resistant automatic faucet assembly.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an automatic faucet assembly rigidly affixed to a surface and electrically coupled to a means for controlling a fluid supply, the automatic faucet assembly comprising: a rigid chassis portion extending above the surface and having a means for discharging fluid at one end and a means for mounting on the surface at another end; a fluid conduit extending through the chassis portion and connecting the fluid discharge means with a fluid supply attached to the mounting means of the chassis portion; means for sensing the presence of a user of the faucet assembly, the sensing means being mounted on the chassis portion between the fluid discharge means and the mounting means; an electrical connector wire extending from the sensing means through an opening in the surface to an area below the surface, wherein the electrical connector wire electrically connects the sensing means to the fluid supply controlling means to turn on the fluid supply when the sensing means senses the presence of the user; means for supplying power to the sensing means, the power supply means being mounted on the chassis portion between the fluid discharge means and the mounting means; means for switching the power supply means to provide electrical power to the sensing means; and a removable cover portion connecting with the chassis portion to provide support and stability to the automatic faucet assembly and a sealed chamber for the fluid conduit, sensing means, electrical connector wire, and power supply means, wherein the switching means is mounted so that when the cover portion is connected to the chassis portion, the switching means enables the power supply means to provide electrical power to the sensing means.

Still in accordance with the objects, the present invention comprises a corrosion-resistant, durable plumbing fixture, including: a zinc die cast layer formed in the shape of the plumbing fixture; a metallic polyester layer formed on the zinc die cast layer for sealing and decorating; and a substantially clear, polymer layer formed on the metallic polyester layer, the polymer layer providing luster, durability, and corrosion resistance for the plumbing fixture.

Even further in accordance with the objects, the present invention comprises a corrosion-resistant, durable automatic faucet assembly rigidly affixed to a surface and electrically coupled to a means for controlling a fluid supply, the automatic faucet assembly including: a chassis portion extending above the surface and having a means for discharging fluid at one end and a means for mounting on the surface at another end; and a removable cover portion connecting with the chassis portion, the removable cover portion including a zinc die cast layer formed in the shape of the cover portion, a metallic polyester layer formed on the zinc die cast layer for sealing and decorating, and a substantially clear, polymer layer formed on the metallic polyester layer, the polymer layer providing luster, durability, and corrosion resistance for the cover portion.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings:

FIG. 1(*b*) is a front view of the automatic faucet assembly shown in FIG. 1(*a*);

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

Figure 1A:
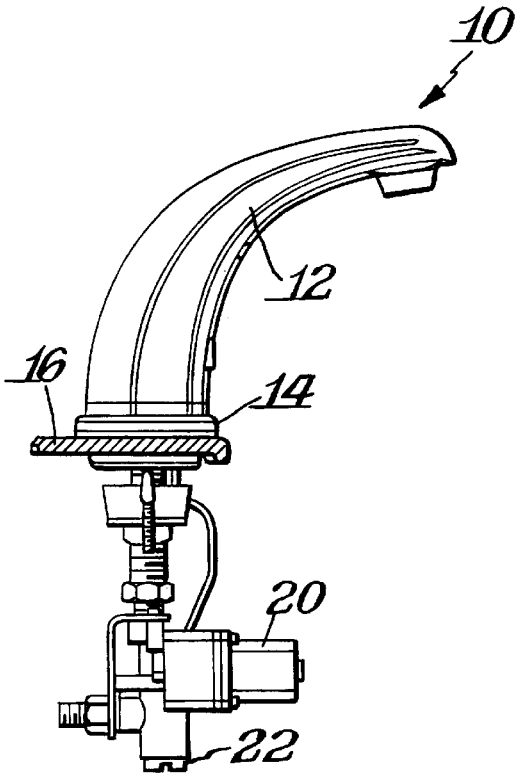
FIG. 1(*a*) is a side view of the automatic faucet assembly in accordance with a preferred embodiment of the present invention.
Figure 1B:
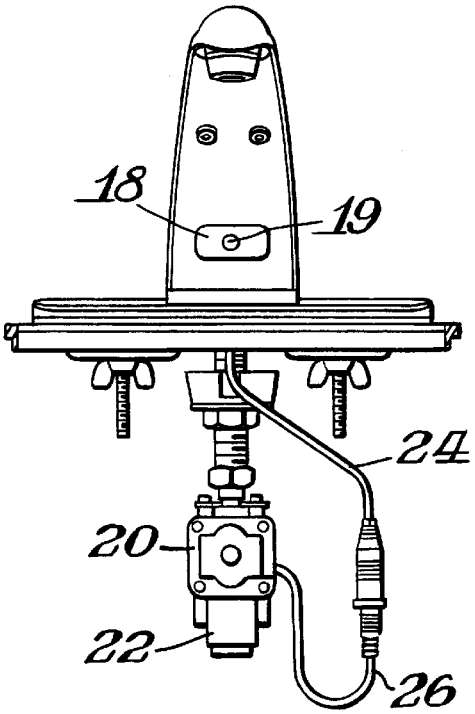

In accordance with the invention, and as shown in FIGS. 1(*a*) and (*b*) as reference numeral 10, the present invention broadly comprises an automatic faucet assembly 12 rigidly affixed to a surface of a deck 16 of a sink basin and electrically coupled to a means for controlling a fluid supply. The fluid supply control means includes a conventional solenoid valve 20 and a conventional water filter 22, as are known in the art. Solenoid valve 20 electrically couples to faucet assembly 12 by connecting wire 24 from faucet assembly 12 to a wire 26 connected to solenoid valve 20.

Figure 2:
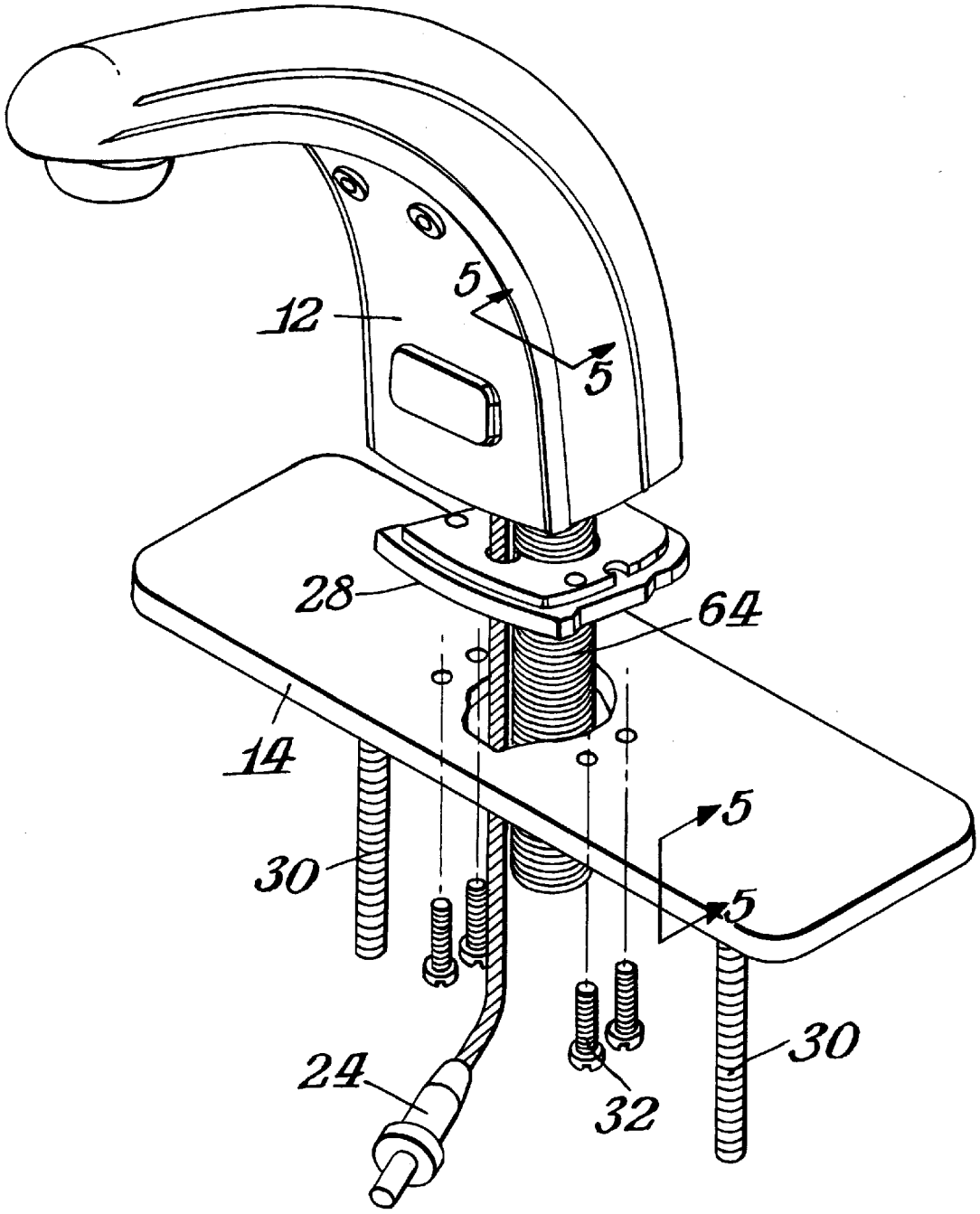
FIG. 2 is an isometric view of the automatic faucet assembly shown in FIG. 1(*a*), and further showing how the automatic faucet assembly interconnects.
Figure 3:
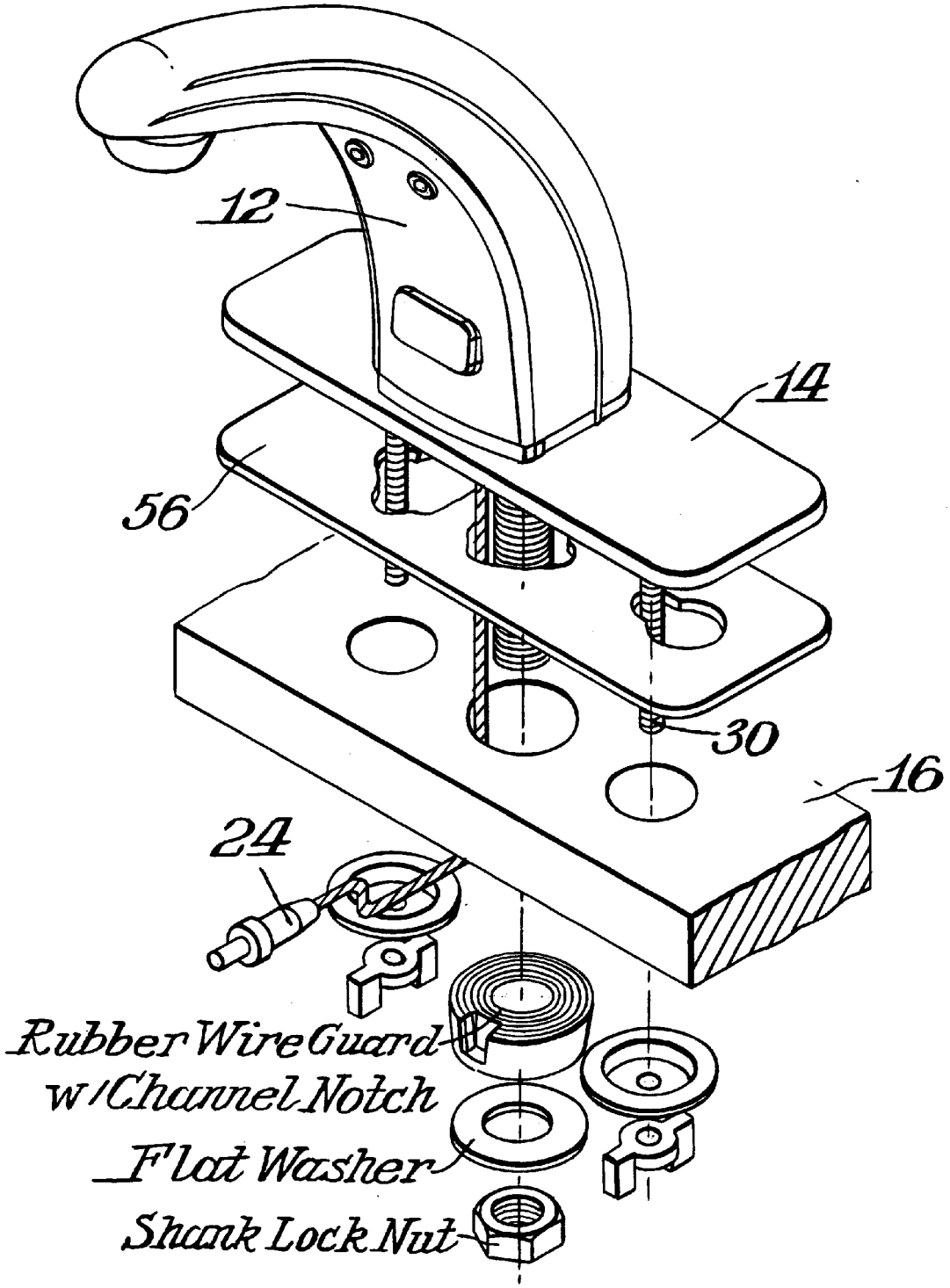
FIG. 3 is an isometric view of the automatic faucet assembly shown in FIG. 1(*a*), and further showing how the automatic faucet assembly interconnects with a deck of a sink basin.

As further shown in FIG. 2, a base gasket 28 mounts between faucet assembly 12 and a deck plate 14, providing a secure, waterproof connection between the two. Preferably, a plurality of screws 32 rigidly connect faucet assembly 12 to deck plate 14, compressing base gasket 28 between them. As best seen in FIG. 3, a gasket 56 mounts between deck plate 14 and the top surface of deck 16, preventing deck plate 14 from slipping on deck 16 and providing a waterproof connection between the two. Deck plate 14 includes two studs 30 extending from its bottom surface. Each stud 30 mates with a corresponding washer 60 and wing nut 58, provided on the underside of deck 16, for rigidly affixing deck plate 14 to deck 16.

Figure 4:
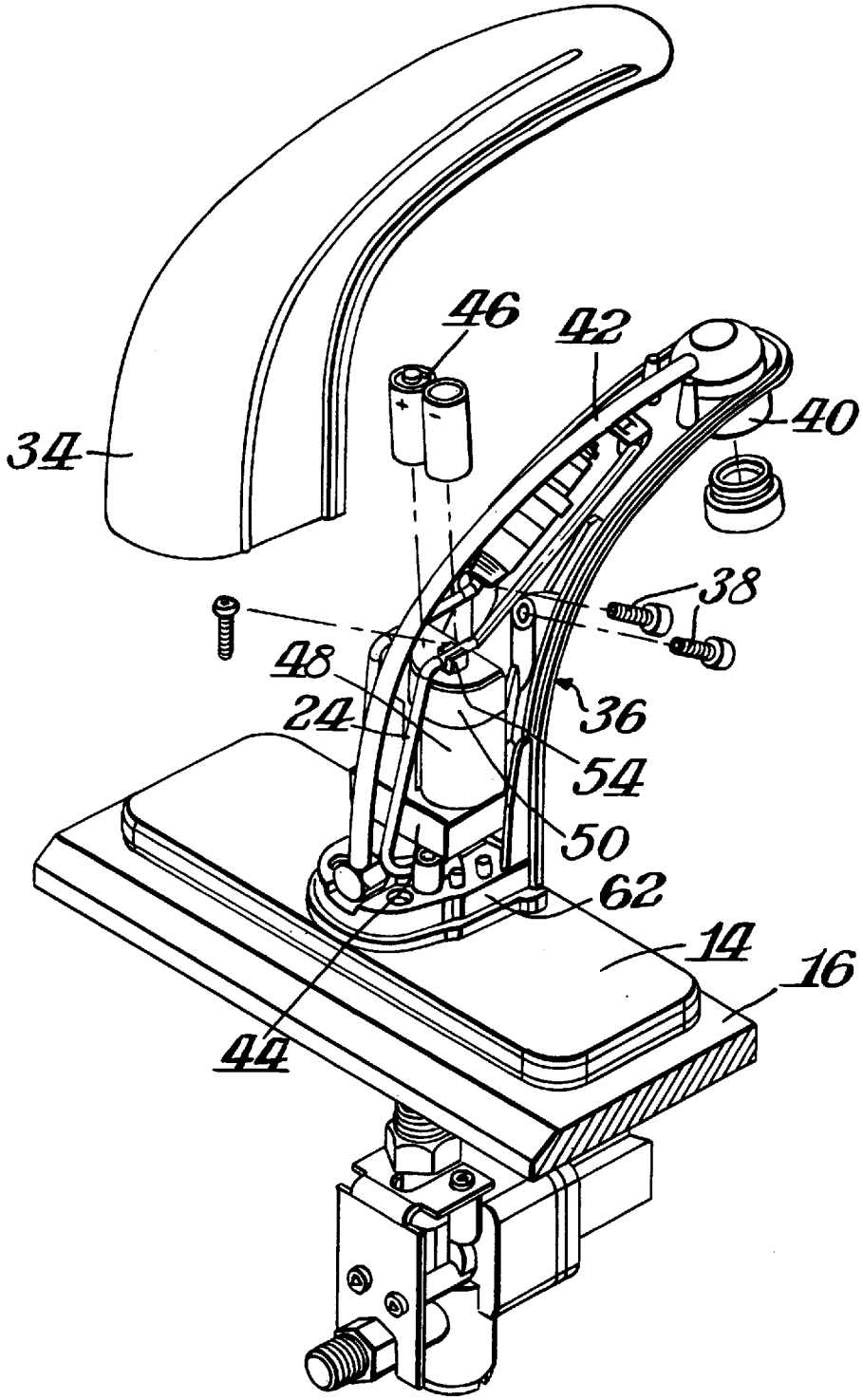
FIG. 4 is an exploded isometric view of the automatic faucet assembly shown in FIG. 1(*a*) with a cover portion removed, and further showing the components comprising the automatic faucet assembly.

As embodied herein, and as best shown in FIG. 4, automatic faucet assembly 12 includes a chassis 36 and a cover 34 removably connected to chassis 36, wherein both chassis 36 and cover 34 extend above the surface of deck 16. Chassis 36 has a means 40 for discharging fluid at one end, and at its other end a means 62 for affixing chassis 36 to the surface of deck 16. Base gasket 28 mounts between mounting means 62 and deck plate 14, via screws 32 (as shown in FIG. 2). Faucet assembly 12 further comprises a fluid conduit 42 extending through chassis 36 and connecting fluid discharge means 40 with a fluid supply 64 attached to mounting means 62 (as shown in FIG. 2). Faucet assembly 12 also includes a means 44 for sensing the presence of a user of faucet assembly 12. Sensing means 44 mounts on chassis 36, between fluid discharge means 40 and mounting means 62. Faucet assembly 12 still further comprises electrical connector wire 24 extending from sensing means 44 through an opening in deck 16 to an area below deck 16, wherein electrical connector wire 24 electrically connects sensing means 44 to solenoid valve 20 to turn on the fluid supply when sensing means 44 senses the presence of the user. Finally, faucet assembly 12 comprises a means for supplying power 46 to sensing means 44, wherein power supply means 46 also mounts on chassis 36 between fluid discharge means 40 and mounting means 62.

Cover 34 connects with chassis 36, preferably via screws 38, providing a sealed chamber for fluid conduit 42, sensing means 44, electrical connector wire 24, and power supply means 46. The integrated, rigid structure of chassis 36 enables a tight seal with cover 34, providing support and stability to automatic faucet assembly 12, and resists abuse typical of most public washrooms. Removal and replacement of cover 34 enables the owners of faucet assembly 12 to refurbish the appearance of cover 34 with a new material, color or design, without replacing the remaining components of faucet assembly 12. The ease of removal of cover 34 from chassis 36 makes servicing of automatic faucet assembly 12 simple and expedient.

Condensation may accumulate on fluid conduit 42 when the water flowing through fluid conduit 42 is cold and the air surrounding fluid conduit is warm and moist. In order to prevent such condensation, fluid conduit 42 is preferable insulated by a number or processes. For example, fluid conduit 42 may be insulated by: (1) powder coating its outer surface with an insulating polymer material; (2) dip coating its outer surface with an insulating vinyl material; or (3) wrapping its outer surface with an insulating material.

Figure 8:
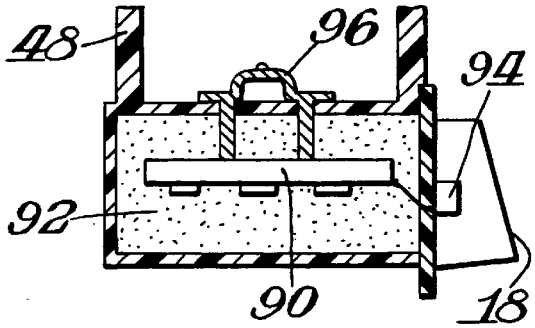
FIG. 8 is a cross-sectional view of a power supply and sensor of the automatic faucet assembly shown in FIG. 1(*a*).

Preferably, sensing means 44 comprises an infrared sensor having an infrared lens 18 (as seen in FIG. 1(*b*)), such as a commercially available Kodak® R27 Grey Card photosensor. The focal distance of the photosensor is fixed by moving the grey card toward the sensor until the grey side of the card reflects the infrared rays back to a sensor emitter and receiver 94 (as shown in FIG. 8). It has been found that various skin tones, as well as light-colored clothing fall into the same range of activation as the Kodak® R27 Grey Card photosensor. Sensing means 44 is preferably set to activate the Kodak® R27 Grey Card photosensor, and thus, automatic faucet assembly 12, when a users hands are placed a distance of five to seven inches from sensing means 44.

As shown in FIG. 8, sensing means 44 further includes a electronic board 90 that is manufactured using surface mount technology. Electronic board 90 is totally potted with an epoxy potting material 92 to prevent moisture and water penetration. Electronic board 90 electrically connects with sensor emitter and receiver 94, and includes a sixty second vandal shutdown timer. If automatic faucet assembly 12 is activated for more than sixty seconds, the sixty second vandal shutdown timer automatically shuts down automatic faucet assembly 12 until the user removes his/her hands from the sensing area of the faucet. Automatic faucet assembly 12 resets the sixty second vandal shutdown timer as soon as the user places his/her hands within the sensing area.

Preferably, power supply means 46 supplies six volts of power to sensing means 44. More preferably, power supply means 46 comprises two standard three-volt lithium batteries. Other manufacturers' standard three-volt batteries may be used with the automatic faucet assembly of the present invention, including Duracell's® DL123A, Eveready's® EL123A, and Panasonic's® CR123A. Furthermore, power supply means 46, preferably includes a low power indicator light 19 for indicating when faucet assembly 12 has approximately 30,000 on/off cycles remaining. As shown in FIG. 1(*b*), low power indicator light 19 preferably is located in the center of infrared lens 18 of sensing means 44. Thus, a faucet owner or maintainer will be able to visually check the functioning of faucet assembly 12 by looking for illumination of low power indicator light 19, enabling them to know when the standard batteries need to be replaced.

In the preferred embodiment of the present invention, the two standard three-volt lithium batteries 46 are provided in a battery case 48 covered by a battery cover 50. A holding screw 52 holds battery cover 50 in contact with battery case 48. Battery case 48 and sensing means 44 are preferably integrally formed. Integral formation of these components provides a compact sensor-power supply assembly that is easily removable from faucet assembly 12, reduces moisture infiltration, and also reduces the space requirements of faucet assembly. As best shown in FIG. 8, electronic board 90 directly connects with battery terminals 96 mounted on battery case 48, eliminating the need for additional wire leads.

Battery case 48 also preferably includes a means 54 for relieving strain in electrical connector wire 24. In the preferred embodiment of the invention, strain relief means 54 comprises two wire clips 54 mounted to a top surface of battery case 48. As seen in FIG. 4, wire clips 54 hold electrical connector wire 24 in place, preventing strain therein, and preventing wire 24 from becoming tangled with other components in automatic faucet assembly 12.

When batteries 46 need to be replaced, they may be easily removed from faucet assembly 12. First, screws 38 are removed and cover 34 is uncoupled from chassis 36. Next, electrical connector wire 24 is unclipped from wire clips 54, and the integrally-formed sensing means 44, battery case 48, and battery cover 50 is removed. Battery cover 50 is then removed from battery case 48 by removing holding screw 52. Finally, the old batteries are replaced with new ones, and the assembly is put back together in a reverse order.

Figure 6:
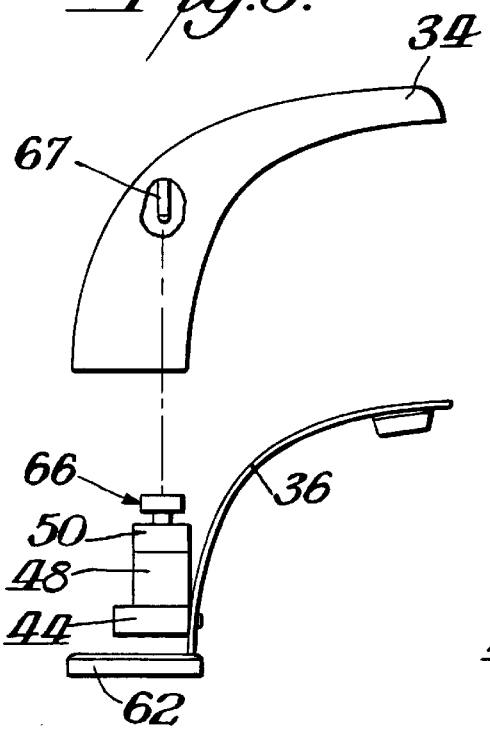
FIG. 6 is a side view of the automatic faucet assembly shown in FIG. 1(*a*), and further showing a switching means for enabling power to be supplied to the automatic faucet assembly.

As shown in FIG. 6 (for clarity, other components have been omitted), automatic faucet assembly 12 further comprises a means 66 for switching power supply means 46, and a switch actuator 67 extending from and connected to cover 34. Switching means 66 preferably mounts to battery cover 50 so that when cover 34 connects to chassis 36, switch actuator 67 engages switching means 66, enabling power supply means 46 to provide electrical power to sensing means 44. Preferably, switching means 66 comprises a mechanical microswitch which activates to an "on" position when cover 34 mounts to chassis 36, completing the circuit between power supply means 46 and sensing means 44 and enabling sensing means 44 to be energized. Switching means 66 automatically deactivates to an "off" position upon removal of cover 34 from chassis portion 36.

Figure 7:
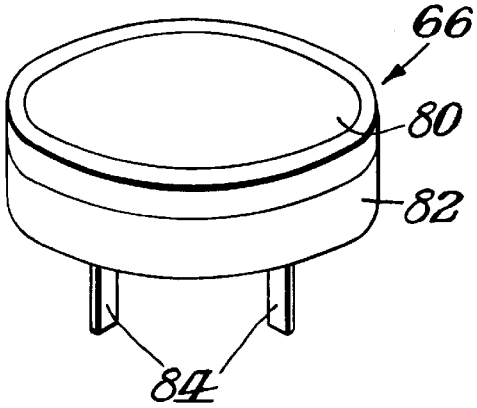
FIG. 7 is an isometric view of the switching means shown in FIG. 6.

Thus, switching means 66 is a momentary "on" switch when activated by switch actuator 67, and returns to the "off" position when switch actuator 67 disengages switching means 66. Such a mechanical microswitch may include a Model No. JF15P2C switch manufactured by NKK® Switches of America, Inc. of Scottsdale, Ariz. The mechanical microswitch 66 prevents a drain on power supply means 46 before faucet assembly 12 is installed. This enables a producer to include power supply means 46 with the complete faucet assembly 12, rather than having an installer incur the time and costs involved installing power supply means 46 when faucet assembly 12 is installed. As seen in FIG. 7, mechanical microswitch 66 comprises a dome contact 80 mounted on body 82 having terminals 84 extending therefrom. Dome contact 80 provides tactile feedback to indicate circuit transfer and assure high reliability. Body 82 is small (0.697 inch diameter) and provides for compact mounting in the faucet assembly. Terminals 84 are crimped to ensure secure mounting and prevent dislodging.

Figure 5:
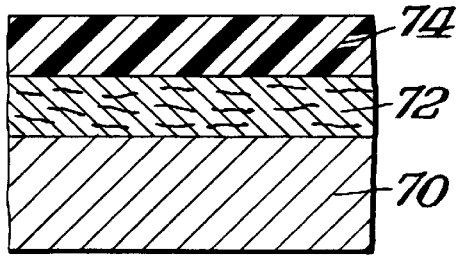
FIG. 5 is a sectional view taken along line 5—5 of the cover portion and the deck plate of the automatic faucet assembly shown in FIG. 2.

Cover 34 and deck plate 14 each preferably comprises a unique corrosion-resistant material. As shown in FIG. 5, the corrosion-resistant material comprises a zinc die cast layer 70 formed in the shape of either cover 34 or deck plate 14, a metallic polyester layer 72 formed on zinc die cast layer 70 for sealing and decorating, and a substantially clear, polymer layer 74 formed on metallic polyester layer 72. Polymer layer 74 provides luster, durability, and corrosion resistance for cover 34 and deck plate 14. Polymer layer 74 may comprise one of a polyamide material or an epoxy material. Making these components using a dual coating over the zinc die cast protects them from corrosion due to today's strong chemical cleaners and soaps. However, use of this dual coating of a zinc die cast material is not limited to the automatic faucet assembly of the present invention. Rather, this dual coating/zinc combination may be used with any plumbing fixture, including but not limited to, toilets, shower heads, urinals, eye wash stations, and on/off handles of conventional faucets. The benefits of using the dual coating over a zinc die cast with plumbing fixtures include its durability, corrosion resistance, reduced cost to produce, and lustrous finish.

The operation of the automatic faucet assembly of the present invention will now be described. When a user places his or her hands adjacent to sensing means 44 and under fluid discharge means 40, sensing means 44 sends an electrical signal to solenoid valve 20, via electrical connector wire 24 and wire 26. Solenoid valve 20 opens, allowing a fluid, such as water, to flow through fluid supply 64 and into fluid conduit 42. The fluid flows through fluid conduit 42, exits faucet assembly 12 at fluid discharge means 40, and flows over the user's hands.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An automatic faucet assembly rigidly affixed to a surface and electrically coupled to a means for controlling a fluid supply, the automatic faucet assembly comprising:

a rigid chassis portion extending above the surface and having a means for discharging fluid at one end and a means for mounting on the surface at another end;

a fluid conduit extending through the chassis portion and connecting the fluid discharge means with a fluid supply attached to the mounting means of the chassis portion;

means for sensing the presence of a user of the faucet assembly, the sensing means being mounted on the chassis portion between the fluid discharge means and the mounting means;

an electrical connector wire extending from the sensing means through an opening in the surface to an area below the surface, wherein the electrical connector wire electrically connects the sensing means to the fluid supply controlling means to turn on the fluid supply when the sensing means senses the presence of the user;

means for supplying power to the sensing means, the power supply means being mounted on the chassis portion between the fluid discharge means and the mounting means;

means for switching the power supply means to provide electrical power to the sensing means; and a removable cover portion connecting with the chassis portion to provide support and stability to the automatic faucet assembly and a sealed chamber for the fluid conduit, sensing means, electrical connector wire, and power supply means, wherein the switching means is mounted so that when the cover portion is connected to the chassis portion, the switching means enables the power supply means to provide electrical power to the sensing means.

2. The automatic faucet assembly of claim 1, further comprising a deck plate mounted between the mounting means of the chassis portion and the surface to provide additional support and stability to the automatic faucet assembly.

3. The automatic faucet assembly of claim 1, wherein the sensing means comprises an infrared sensor having an infrared lens.

4. The automatic faucet assembly of claim 1, wherein the sensing means and a casing for the power supply means are integrally formed.

5. The automatic faucet assembly of claim 4, further comprising:

means for relieving strain in the electrical connector wire, the strain relief means being provided adjacent to the power supply means.

6. The automatic faucet assembly of claim 5, wherein the strain relief means comprises a plurality of clips mounted to a top surface of the casing for the power supply means.

7. The automatic faucet assembly of claim 1, wherein the power supply means supplies six volts of electrical power to the sensing means.

8. The automatic faucet assembly of claim 5, wherein the power supply means comprises two standard three-volt batteries.

9. The automatic faucet assembly of claim 1, wherein the power supply means has a low power indicator light for indicating when the faucet assembly has approximately 30,000 on/off cycles remaining.

10. The automatic faucet assembly of claim 1, further comprising:

means for relieving strain in the electrical connector wire, the strain relief means being provided adjacent to the power supply means.

11. The automatic faucet assembly of claim 10, wherein the strain relief means comprises a plurality of clips mounted to a top surface of a casing for the power supply means.

12. The automatic faucet assembly of claim 1, wherein the fluid conduit further comprises an insulating material that prevents condensation from accumulating on an outer surface of the fluid conduit.

13. A corrosion-resistant, durable automatic faucet assembly rigidly affixed to a surface and electrically coupled to a means for controlling a fluid supply, the automatic faucet assembly comprising:

a chassis portion extending above the surface and having a means for discharging fluid at one end and a means for mounting on the surface at another end; and a removable cover portion connecting with the chassis portion, the removable cover portion including a zinc die cast layer formed in the shape of the cover portion, a metallic polyester layer formed on the zinc die cast layer for sealing and decorating, and a substantially clear, polymer layer formed on the metallic polyester layer, the polymer layer providing luster, durability, and corrosion resistance for the cover portion.

14. The corrosion-resistant, durable automatic faucet assembly recited in claim 13, further comprising:

a deck plate mounted between the mounting means of the chassis portion and the surface to provide support and stability to the automatic faucet assembly, the deck plate including a zinc die cast layer formed in the shape of the deck plate, a metallic polyester layer formed on the zinc die cast layer for sealing and decorating, and a substantially clear, polymer layer formed on the metallic polyester layer, the polymer layer providing luster, durability, and corrosion resistance for the deck plate.

15. The corrosion-resistant, durable automatic faucet assembly recited in claim 14, wherein the polymer layer of the removable cover portion and the deck plate comprises one of a polyamide material and an epoxy material.

* * * * *